US006071146A

United States Patent [19]

Horner

[11] Patent Number: 6,071,146

[45] Date of Patent: Jun. 6, 2000

[54] SEAL FOR DISPOSITION BETWEEN WIRES AND THEIR RECEIVING CONNECTOR

[75] Inventor: Patrick L. Horner, Cuyahoga Falls, Ohio

[73] Assignee: Quality Synthetic Rubber, Inc., Twinsburg, Ohio

[21] Appl. No.: 08/867,368

[22] Filed: Jun. 2, 1997

[51] Int. Cl.[7] ..... H01R 13/52

[52] U.S. Cl. ..... 439/587; 439/275

[58] Field of Search ..... 439/274, 275, 439/587, 589

[56] References Cited

U.S. PATENT DOCUMENTS

| | | | |
|---|---|---|---|
| 3,327,282 | 6/1967 | Krolak . | |
| 3,336,569 | 8/1967 | Nava | 439/589 |
| 4,084,875 | 4/1978 | Yamamoto | 439/274 |
| 4,241,967 | 12/1980 | Collins | 439/589 |
| 4,260,966 | 4/1981 | Boutros | 333/182 |
| 4,664,461 | 5/1987 | Schubert et al. . | |
| 5,116,236 | 5/1992 | Colleran et al. | 439/271 |
| 5,145,410 | 9/1992 | Maejima et al. | 439/587 |
| 5,151,045 | 9/1992 | Cravens et al. | 439/271 |
| 5,299,949 | 4/1994 | Fortin | 439/275 |
| 5,540,450 | 7/1996 | Hayashi et al. | 439/275 |
| 5,545,062 | 8/1996 | Takagishi et al. | 439/877 |
| 5,569,051 | 10/1996 | Endo et al. | 439/587 |
| 5,593,321 | 1/1997 | Hotea | 439/589 |

*Primary Examiner*—Neil Abrams
*Attorney, Agent, or Firm*—Renner, Kenner, Greive, Bobak, Taylor & Weber

[57] ABSTRACT

A seal for disposition between a connector and a wire includes opposed faces having at least one wire hole therethrough, an outer sealing surface connecting said opposed faces and contacting the connector, said at least one wire hole having at least two inwardly extending compressive ribs contacting an outer surface of the wire wherein the ribs have a notch therebetween. The inwardly extending compressive ribs each have a contacting apex extending from lead-in side surface which extend from the respective opposed faces, and the notch has a diameter less than a diameter of a connection point between the lead-in side edges and the opposed faces.

13 Claims, 2 Drawing Sheets

SEAL FOR DISPOSITION BETWEEN WIRES AND THEIR RECEIVING CONNECTOR

TECHNICAL FIELD

The invention herein resides generally in the art of seals. More particularly, the present invention relates to seals which preclude entry of contaminants into an electrical connection area. Specifically, the present invention relates to seals which employ compressive ribs which do not permanently deflect and that preclude entry of harmful materials into an electrical connection area.

BACKGROUND ART

In order to prevent contaminants from entering areas of contact between electrical connections, it is imperative to provide a seal between the connector and wires received therein. It is well known that electrical connections are made by attaching mating terminals to the wires to be connected. Entry of contaminants, such as water, corrosive fluids, gases and the like, into the connection area can cause short circuits between electrical conductors, interrupt the electric connection between mating terminals, or interfere with the transmitted signal.

It is well known that relatively tight connections can be made between mating connectors and between the connectors and the received wire; however, there are always slight gaps therebetween. These gaps may be caused by mismatched tolerances in the connectors; excessive force used in mating the connectors, or in loading the wires into the connectors; or even slight vibrations after the connectors have been mated, or after the wires have been inserted. It will also be appreciated that some connectors with received wires are placed in pressurized environments with extreme temperature fluctuations. These variations further exacerbate any gaps between the connectors or wires received therein.

To block these gaps between connectors and the wires that they receive it is known to provide elastomeric seals therebetween. These seals typically have substantially inwardly extending ribs that are compressed when a wire is received through a seal. Unfortunately, these ribs often over deflect and get cut or pinched. As will be appreciated, once this seal is ineffective, contaminants may enter the connection area and lead to the aforementioned problems. Yet another problem associated with current seals is that the terminals attached to the wires invariably damage the sealing ribs if several insertions and withdrawals of the wire are made through the seal. Once the inwardly extending ribs of such a seal are damaged, the seal around the wire becomes ineffective. Still another problem with current seals is that the sealing ribs are positioned such that, when flexed, they are likely to be pinched or cut. This results in a seal that provides wide center-to-center spacing. In other words, current seals do not provide or accommodate the large number of wires required by hi-density connectors.

Therefore, there is a need in the art for a more efficient seal between mating connectors and between connectors and wires received therein.

DISCLOSURE OF INVENTION

In light of the foregoing, it is a first aspect of the present invention to provide a seal for disposition between a connector and a wire received therein.

Another aspect of the present invention is to provide a seal carried by one of the mating connectors which has a hole with a perimeter that exerts a compressive force on the wire received therein.

Still a further aspect of the present invention, as set forth above, is to provide the perimeter of the hole with inwardly compressive ribs that do not remain folded over onto the interior surface from which they extend when a wire is inserted therethrough, but recover and return to circumferential engagement with the wire.

An additional aspect of the present invention, as set forth above, is to provide the hole with tapered lead-in surfaces resulting in a low insertion force for a properly prepared terminal, which is one without a razor edge, wherein the terminal is attached to the wire and wherein the combination of the tapered lead-in surfaces and compressive ribs allow more than 5 and up to 50 insertions and extractions of the wire and the terminal without diminishing the effectiveness of the seal.

Yet an additional aspect of the present invention, as set forth above, is to provide the perimeter hole with at least two inwardly extending compressive ribs with a notch therebetween wherein the notch has a diameter less than an opening diameter of the hole.

Another aspect of the present invention, as set forth above, is to provide a plurality of holes with reduced center-to-center spacing.

The foregoing and other aspects of the invention which shall become apparent as the detailed description proceeds, are achieved by a seal for disposition between a connector and a wire, comprising opposed faces having at least one wire hole therethrough; an outer sealing surface connecting the opposed faces and contacting the connector; the at least one wire hole having at least two inwardly extending compressive ribs contacting an outer surface of the wire, said ribs having a notch therebetween, the inwardly extending compressive ribs having a contacting apex extending from lead-in side surfaces connected to respective opposed faces, the notch having a diameter less than a diameter of a connection point between the lead-in side edges and the opposed faces.

The present invention also provides a seal that surrounds a wire for precluding entry of contaminants into an electrical connection area, comprising a pair of opposed faces having a plurality of wire holes extending therethrough, each of the wire holes having an interior sealing surface that exerts a compressive force on a wire received therein, the interior sealing surface providing a plurality of compressive ribs concentric with the wire hole, the compressive ribs having a notch therebetween that is concentric with the wire hole, the notch having a diameter less than a diameter of any point between the outermost compressive ribs and their adjacent opposed face.

The present invention further provides a method for determining a shape of an interior sealing surface provided by a seal disposed around a wire with an attached terminal, comprising the steps of measuring a diameter of the attached terminal for designation as diameter A; multiplying a measured diameter of the wire times about 60% for designation as diameter B; measuring a thickness of the seal for designation as dimension C; calculating a radius value D by multiplying dimension C times a factor x; calculating a radius value E by multiplying dimension C times a factor y; calculating a radius value F by multiplying dimension C times a factor z; determining a plurality of first intersection points by multiplying dimension C times values less than 1; calculating a plurality of second intersection points by employing the radius values D, E and F and diameters A and B; and employing the plurality of first and second intersection points, the diameters A and B, and the radiuses D, E and F to construct the shape of the interior sealing surface.

BRIEF DESCRIPTION OF THE DRAWINGS

For a complete understanding of the objects, techniques and structure of the invention, reference should be made to the following detailed description and accompanying drawings wherein.

BEST MODE FOR CARRYING OUT THE INVENTION

Figure 1:
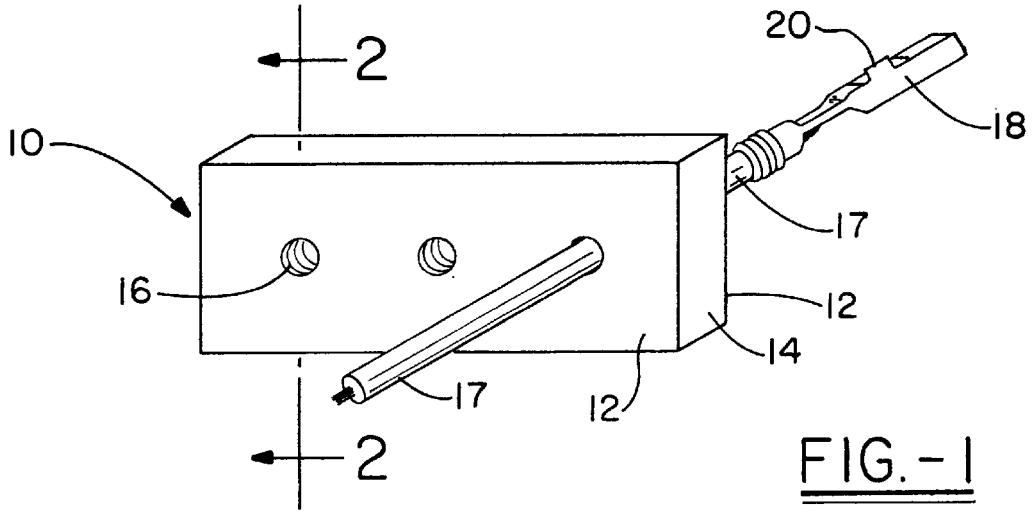
FIG. 1 is an enlarged perspective view of a mat seal with an outer sealing edge and an inner sealing wire hole.

Referring now to the drawings, it can be seen that a mat seal for providing a seal between a connector and a wire received therein to preclude entry of undesired fluids, gases and the like is designated generally by the numeral 10. The mat seal 10, which in the preferred embodiment is made of a substantially resilient elastomeric material having a durometer of between about 10 to 60 (Shore A scale), includes a pair of opposed faces 12 that are interconnected by an outer sealing surface 14. Although a rectangularly-shaped seal is shown in FIG. 1, it will be appreciated that the concepts of the present invention may be employed with any shape or size of seal.

The mat seal 10 has at least one wire hole 16 which extends through the opposed faces 12. Each wire hole 16 receives a wire 17 which has a terminal 18 attached to the conductor of the wire in a manner well known in the art. Usually the terminal 18 has a tine 20 or other locking feature for securably attaching the terminal inside a connector housing. It will be appreciated that the terminal 18 may be provided in a socket, a box, a pin, a post or any other known configuration. It will also be appreciated that a properly crimped terminal has relatively smooth edges. In other words, the leading edge of the terminal is to be prepared without a razor edge that might prematurely damage the periphery of the wire hole. Once the connector housing is completely loaded with wires 17, the connector is mated with a receptacle connector for interconnecting the wires 17 to an appropriate piece of equipment or the like.

Figure 2A:
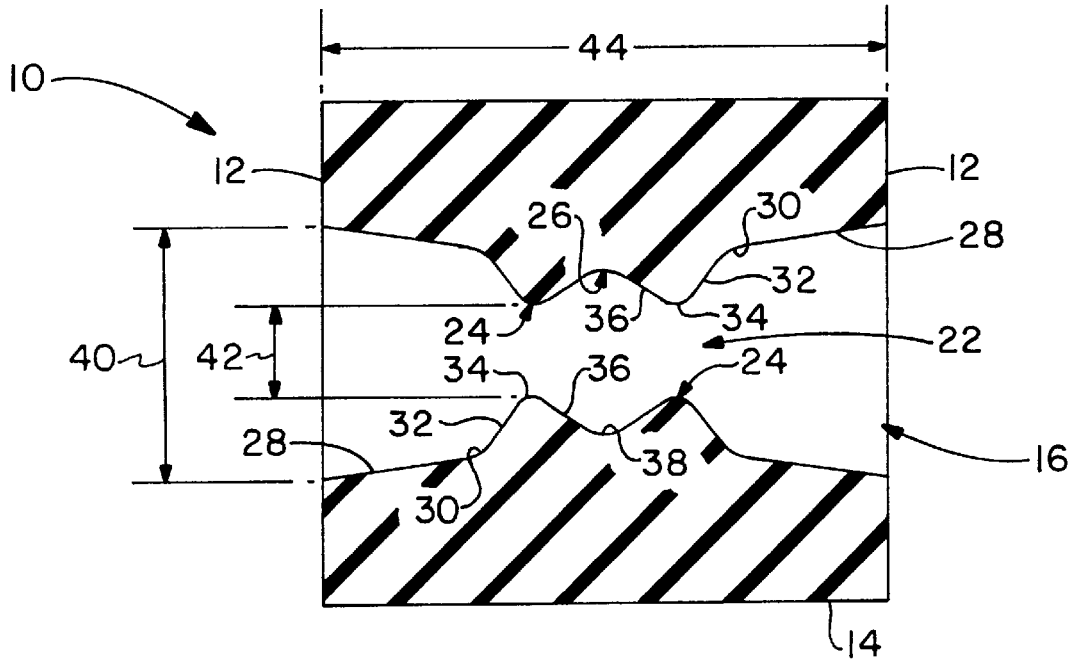
FIGS. 2A and 2B are enlarged cross-sectional views of the interior of a wire hole taken along lines 2—2 of FIG. 1.
Figure 2B:
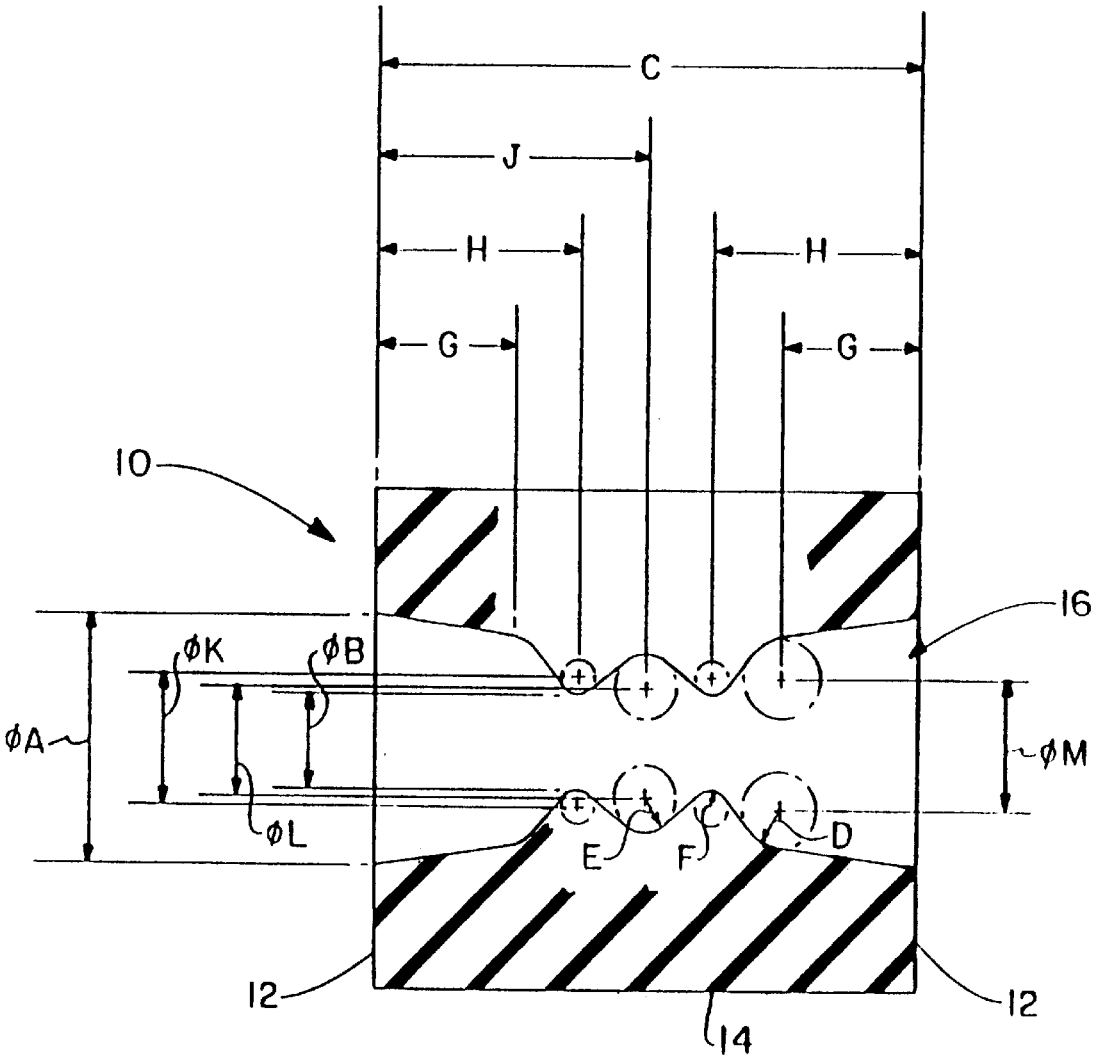

In order to prevent fluids or contaminants from interfering with the electrical connection made between the wires and the piece of equipment, the wire 17 must be sealingly engaged by the perimeter of respective wire hole 16 and a seal must be established between the outer sealing surface 14 and the connector in which it is received. As best seen in FIGS. 2A and 2B, an effective seal arrangement is obtained by the wire hole 16 which exerts a compressive sealing force around the inserted wire 17.

The wire hole 16 provides an interior sealing surface 22 which is substantially circular in shape when viewed from the opposed face 12 and which is designed to provide an effective compressive sealing force. The hole 16 also provides a low insertion force for repeatably receiving the wire and for repeatably withdrawing the wire if necessary. The present design has been found to allow up to 50 cycles of insertion and withdrawal for a wire and properly attached terminal into the hole 16 without damaging the interior sealing surface 22. The interior sealing surface 22 includes at least two compressive ribs 24 with a notch 26 between each rib. The interior sealing surface 22 starts at one opposed face 12 with a lead-in taper surfaces 28 which transitions at a connection point 30 to a lead-in side surfaces 32 of the compressive rib 24. The lead-in side surfaces 32 extends into an apex 34 which extends to a trailing side 36 which is contiguous with a vertex 38 of the notch 26. The remaining structure of the interior sealing surface 22 is essentially a mirror image from the vertex 38 to the opposite face 12. In other words, from the vertex 38, the interior sealing surface 22 continues to a trailing side 36 of an adjacent compressive rib 24. From the second trailing side 36, the interior surface 22 continues to an apex 34, a lead-in side surfaces 32, a connection point 30 and a lead-in taper edge 28. Although only two compressive ribs 24 are shown in this embodiment, it will be appreciated that a plurality of compressive ribs 24 with notches 26 therebetween could be provided.

In order to obtain a seal between the mat seal 10 and the received wires 17, three primary dimensions and diameters are established to determine the dimensional shape and structure of the wire hole 16. The first is a seal opening 40, which has a diameter $\phi A$, that is presented at both of the opposed faces 12. Diameter $\phi A$ is equal to the size or diameter of the terminal or may be established by the hole center-to-center spacing, whichever is less. The second primary diameter for the interior sealing surface 22 is a compression opening 42 that is designated by a diameter $\phi B$. The compression opening 42 is equal to about 60 percent of the insulation diameter, that is the outer diameter of the wire 17, of the smallest specified wire size to be received in the mat seal 10. The third primary dimension is a seal thickness 44, which is designated as dimension C, which is either a customer specified height or a value equal to or less than a well height in which the mat seal 10 is received. From these three primary diameters and dimensions, the structure of the interior sealing surface 22 can be determined.

In particular, from the seal thickness 44, dimension C, radius values are determined which in turn are employed to configure the connection point 30, the apex 34 and the vertex 38. A value for a radius D is derived by multiplying dimension C times x, where x equals about 0.055±0.013. A similar value is also derived for radius E by multiplying dimension C times y, where y equals about 0.055±0.013. A radius value F is derived by multiplying dimension C times z, where z is equal to about 0.045±0.013. Values or factors x, y and z have been determined effective when used in combination with the other measured dimensions to form an effective seal around the wire while providing optimum tear resistant properties for the seal. The tolerance limits associated with values x, y and z are employed to allow for variations in the outer diameter of the wire 17 and to allow for variations in the hardness and compatibility of the wire insulation material with the seal 10.

The radius dimensions D, E and F are located at first intersecting points or width positions G, H and J. Positions G, H and J are measurable from the opposed faces inwardly. If more than two ribs are desired, appropriate multiplying values less than 1.0 will need to be used to derive the first set of intersecting point. In the preferred embodiment, the G value is derived by multiplying dimension C times 0.25, the H value is derived by multiplying dimension C times 0.375, and the J value is derived by multiplying dimension C times 0.5. Thus, it will be appreciated that the compressive ribs 24 are positioned within the middle half of the interior sealing surface 22. In other words, the lead-in taper edge 34 comprises the outer quarter of each end of the interior sealing surface 22.

Second intersecting points for each of the radius values D, E and F are derived by calculating diameter values $\phi K$, $\phi L$ and $\phi M$. In particular, the diameter $\phi K$ is equal to $(((A-B)/2)+B)-D$. The value for diameter $\phi L$ is equal to $((A-B/2)+B)-(2*E)$. The value for $\phi M$ is equal to $(B+(2*F))$. With these dimensions, radiuses, and diameters, it can be seen that the proper locations for the connection point 30, the apex 34 and the vertex 38 can be established. In particular, the connection point 30 is established by utilizing an intersection between dimension G and diameter ϕK and outwardly extending from this intersection, the radius value D. This provides a smooth transition between the lead-in taper surface 28 and the lead-in side surface 32. The apex 34 of the compressive rib 24 is derived by intersection of dimension H with the diameter ϕM and inwardly extending from this intersection radius value F. The location of the notch 32 is derived from the intersection of dimension J with the diameter ϕL and extending outwardly therefrom the radius value E which provides a transition between the vertex 38 and the adjacent trail sides 36. As best seen in FIG. 2, all the diameters, ϕA, ϕB, ϕK, ϕL and ϕM are concentric with one another.

Therefore, it will be appreciated that careful selection of the dimensions, diameters and radiuses associated with the interior sealing surface 22 results in effective compressive sealing ribs 24 that do not remain folded over upon the lead-in taper edge 28 or the notch 26 after deflection, while effectively sealing around the inserted wire 17. A close examination of the interior sealing surface 22 reveals that the diameter of the vertex 38 is less than a diameter of the connection point 30 which in turn has a diameter less than the seal opening 40. By providing additional material in between the compressive ribs 24 at the notch 26 than normally found in the prior art, the ribs 24 are less likely to fold over upon themselves and contact other areas of the interior sealing surface 22 and in particular, the lead-in taper surface 38. Other advantages of the seal 10 are that the lead-in taper surface 38 allows for easy insertion of the terminal attached to the wire 17 and also furthers the distance that the compressive rib 24 must travel to contact the interior sealing surface 22. It has also been determined that the improved insertion properties of the interior sealing surface 22 allow for a reduced center-to-center spacing of the wire holes 16. The present design has been found more effective in sealing while also reducing the amount of surrounding material, thereby increasing the number of wires that can be accommodated by a predetermined size of seal. This allows the seal 10 to be used with hi-density connectors.

Thus, it can be seen that the objects of the invention have been satisfied by the structure presented above. While in accordance with the patents statutes, only the best mode and preferred embodiments of the invention have been presented and described in detail, the invention is not limited thereto or thereby. Accordingly, for an appreciation of the true scope and breadth of the invention, reference should be made to the following claims.

What is claimed is:

1. A seal for disposition between a connector housing and a wire, comprising:

opposed faces having at least one wire hole therethrough;

an interior sealing surface connecting said opposed faces to form said at least one wire hole;

said interior sealing surface having at least two inwardly extending compressive ribs contacting an outer surface of the wire, said ribs having a notch therebetween, said inwardly extending compressive ribs having a contacting apex, each said rib having trailing sides that extend from said apex toward said notch, each said outermost rib having lead-in side surfaces extending toward said opposed faces, said notch having a diameter less than a diameter of the hole at a connection point between said lead-in side surfaces and said opposed faces, wherein said at least one wire hole has a seal opening with a diameter greater than the diameter of the hole at said connection point to form lead-in taper surfaces, said trailing sides having a significantly more shallow taper than said lead-in taper surfaces; wherein a thickness of said outer sealing edge has a dimension C that is employed to derive a plurality of radius values associated with said connection point, said compressive ribs and said notch; and wherein said seal has a first plurality of intersection points for said plurality of radius values derived from said dimension C such that said first and second plurality of intersection points intersect to position the location of radiuses associated with said connection point, said compressive ribs and said notch, said compressive ribs only being positioned within about a middle section of said seal equal to about one-half of dimension C, wherein the seal is made of an elastomeric material having a durometer hardness that allows deflection of said compressive ribs as the wire passes through said wire hole without said compressive ribs remaining in contact with said lead-in taper surfaces upon completion of wire insertion.

2. The seal according to claim 1, wherein said seal has a diameter A associated with said seal opening and a diameter B associated with a compression opening which are employed to derive additional diameter values that function as a first plurality of intersection points for said plurality of radius values.

3. The seal according to claim 1, wherein said compressive ribs maintain contact with an outer surface of the wire without remaining folded over and contacting said lead-in taper edges and said notch.

4. The seal according to claim 3, wherein said seal is made of an elastomeric material having a durometer hardness of about 18.

5. The seal according to claim 1, wherein the method for determining a shape of an interior sealing surface provided by the seal disposed around the wire having an attached terminal, comprises the steps of:

measuring a diameter of the attached terminal for designation as diameter A;

multiplying a measured diameter of the wire times about 60% for designation as diameter B;

measuring a thickness of the seal for designation as dimension C;

calculating a radius value D by multiplying dimension C times a factor x;

calculating a radius value E by multiplying dimension C times a factor y;

calculating a radius value F by multiplying dimension C times a factor z;

determining a plurality of first intersection points by multiplying dimension C times values less than 1;

calculating a plurality of second intersection points by employing said radius values D, E and F and diameters A and B; and employing said plurality of first and second intersection points, said diameters A and B, and said radiuses D, E and F to construct the shape of the interior sealing surface.

6. The method according to claim 5, wherein said step of calculating said plurality of first intersection points comprises the steps of:

multiplying dimension C times 0.25 for designation as dimension G which is measured from either opposed face of the seal;

multiplying dimension C times 0.375 for designation as dimension H which is measured from each opposed face of the seal;

multiplying dimension C times 0.5 for designation as dimension J which is measured from each opposed face of the seal.

7. The method according to claim 6, wherein said step of calculating said plurality of second intersection points comprises the steps of:

calculating a diameter K from the formula (((A−B/2)+B)−D);

calculating a diameter L from the formula ((A −B/2)+B)−(2*E); and calculating a diameter M from the formula (B +(2*F)).

8. The method according to claim 7, wherein the interior sealing surface includes a pair of compressive ribs with a notch therebetween and connection points between the compressive ribs and opposed faces of the seal, wherein these attributes are located by the steps of:

intersecting dimension G with diameter K and using radius D outwardly therefrom to establish the connection point between respective compressive ribs and opposed faces;

intersecting dimension H with diameter M and using radius F inwardly therefrom to establish an apex of said compressive ribs; and intersecting dimension J with diameter L and using radius E outwardly therefrom to establish a vertex of said notch.

9. A seal that surrounds a wire for precluding entry of contaminants into an electrical connection area, comprising:

a pair of opposed faces having a plurality of wire holes extending therethrough, each of said wire holes having an interior sealing surface that exerts a compressive force on a wire received therein, said interior sealing surface providing a plurality of compressive ribs concentric with said wire hole, said compressive ribs having a notch therebetween that is concentric with said hole at the wire hole, said notch having a diameter less than a diameter of the hole at any point between each of the outermost compressive ribs and their adjacent opposed face, wherein said interior sealing surface has a lead-in taper surface between the outermost compressive ribs and their adjacent opposed face, each said lead-in taper surface extending at least one-quarter of the way in from each said opposed face, wherein said ribs have trailing sides extending to said notch, said trailing sides having a significantly more shallow taper than said lead-in taper surfaces wherein the seal is made of an elastomeric material having a durometer hardness that allows deflection of said compressive ribs as the wire passes through said wire hole without said compressive ribs remaining in contact with said lead-in taper surfaces upon completion of wire insertion.

10. The seal according to claim 9, wherein a thickness between said pair of opposed faces is employed to derive a plurality of radius values associated with said compressive ribs and said notches.

11. The seal according to claim 9, wherein said interior sealing surface has a seal opening larger than an outer diameter of the wire and wherein each of said compressive ribs has an apex that is equal to about 60% of the wire diameter.

12. The seal according to claim 11, wherein a diameter of said notch is determined by:

calculating a radius value by multiplying the distance between said pair of opposed faces times about 0.055±0.013;

calculating a diameter value by using the formula ((A−B/2)+B), wherein A equals the diameter of said wire hole at said opposed face, wherein B equals about 60% of the wire diameter;

multiplying said calculated radius value times two and adding this value to said calculated diameter value.

13. The seal according to claim 11, wherein a diameter of said compressive rib is determined by:

calculating a radius value by multiplying the distance between said pair of opposed faces times about 0.045±0.013; and multiplying said calculated radius value times two and adding this value to a value of about 60% of the wire diameter.

* * * * *